United States Patent [19]

Bunyea et al.

[11] Patent Number: 4,875,879

[45] Date of Patent: Oct. 24, 1989

[54] CORD RETAINER FOR A PORTABLE ELECTRIC TOOL

[75] Inventors: Roderick F. Bunyea, Westminster; Donald W. Zurwelle, Lutherville, both of Md.

[73] Assignee: Black & Decker Inc., Newark, Del.

[21] Appl. No.: 193,028

[22] Filed: May 11, 1988

[51] Int. Cl.[4] ..... H01R 13/72

[52] U.S. Cl. ..... 439/501; 15/410; 439/457

[58] Field of Search ..... 439/367–373, 439/451, 452, 456–458, 460, 470, 471, 481, 501, 558; 248/51, 52; 24/16 R, 16 PB; 7/167, 168; 15/143 R–145, 410; 81/489–492; 30/347, 340, 276, 388

[56] References Cited

U.S. PATENT DOCUMENTS

| | | | |
|---|---|---|---|
| 1,719,766 | 7/1929 | Hopkins | 248/52 |
| 3,593,950 | 7/1971 | Tetzlaff | 248/52 |
| 3,611,265 | 10/1971 | Shurtz | 439/369 |
| 3,843,224 | 10/1974 | Gerke, Jr. et al. | 439/481 X |
| 4,047,299 | 9/1977 | Bair | 30/347 X |
| 4,167,301 | 9/1979 | Mundschenk . | |
| 4,585,194 | 4/1986 | Schwob . | |
| 4,719,379 | 1/1988 | Daniels et al. . | |

FOREIGN PATENT DOCUMENTS

| | | |
|---|---|---|
| 0038014 | 4/1981 | European Pat. Off. . |
| 651504 | 4/1951 | United Kingdom . |
| 1445908 | 8/1976 | United Kingdom . |

OTHER PUBLICATIONS

"Paramount Owner's Manual", Model 960-00, Lawn Edger, Copyright 1987.

Allegretti & Company, Chatsworth, Calif., (p. 3 and FIG. 3).

"Weed Eater Operator's Manual", Model 1214, Model 1216, Beaird-Poulan/Weed Eater, Shreveport, La.

2 Photographs, Paramount Model 960 Lawn Edger, Allegretti & Company.

*Primary Examiner*—Eugene F. Desmond

*Attorney, Agent, or Firm*—Harness, Dickey & Pierce

[57] ABSTRACT

A cord retention system for a portable electric power tool such as a string trimmer, hedge trimmer, or drill, that is adapted to releasably secure a loop of extension cord in a cavity formed in the handle of the tool. A retaining member pivotably mounted within the cavity in the handle is adapted to capture the loop of extension cord and secure it against withdrawal in its normally biased lock position. To release the extension cord, the user actuates the retaining member causing it to pivot upwardly and free the loop of extension cord, thereby permitting withdrawal of the cord from the handle. The retaining member has a cam surface on its leading edge that is engaged by the loop of cord as it is inserted into the cavity in the handle so that the retaining member will automatically pivot upwardly into the release position to permit the loop of cord to be inserted beyond the retaining member, and thereafter pivot downwardly into the lock positon under the bias of a spring.

68 Claims, 4 Drawing Sheets

CORD RETAINER FOR A PORTABLE ELECTRIC TOOL

BACKGROUND AND SUMMARY

The present invention relates to portable electric power tools and in particular to a cord retainer for holding an extension cord that is plugged into a portable electric tool in a manner that permits the extension cord to be readily removed.

Many portable outdoor electric power tools, such as string trimmers and hedge trimmers, are typically provided with very short power cords as these tools are intended to be used with lengthy extension cords. However, it is often a problem when operating such tools preventing the extension cord from becoming disconnected from the power tool. Even when the end of the extension cord is looped around and tied to the end of the power tool cord, the plug ends can nonetheless work themselves apart sufficiently as the tool is being used to interrupt power to the tool. Moreover, as it becomes more common for power tools to be equipped simply with a male electric receptacle, eliminating the integral power cord altogether, the need for a convenient means of removably securing an extension cord to a power tool becomes even more apparent.

Accordingly, it is the primary object of the present invention to provide an improved cord retaining system for a portable electric power tool.

In addition, it is an object of the present invention to provide a cord retaining system that is integral with the power tool and provides a convenient means for removably securing the end of an extension cord to the power tool.

Furthermore, it is an object of the present invention to provide an improved cord retaining system that is convenient and simple to use, and yet is inexpensive to manufacture and does not detract from the overall external appearance of the power tool.

It is also an object of the present invention to provide an improved cord retaining system for portable electric tools that is adapted to securely retain cords of many different thicknesses or diameters.

Additional objects and advantages of the present invention will become apparent from a reading of the following detailed description of the preferred embodiments which makes reference to the drawings in which:

BRIEF DESCRIPTION OF THE DRAWINGS

FIG. 3 is a bottom view of the handle portion shown in FIG. 2;

DETAILED DESCRIPTION OF THE PREFERRED EMBODIMENTS

Figure 1:
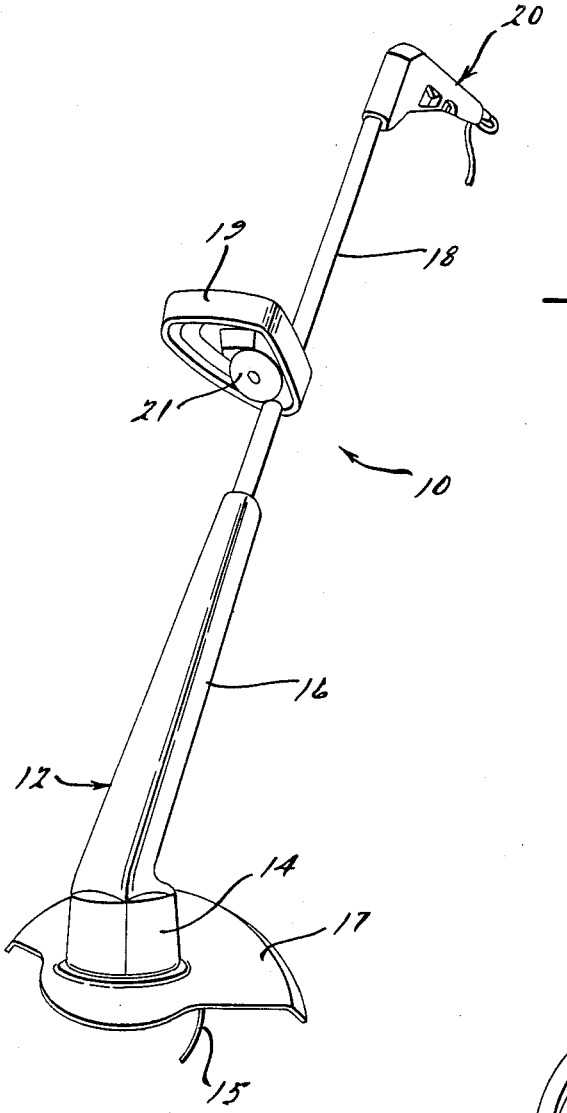
FIG. 1 is a perspective view of a portable electric string trimmer incorporating the cord retaining system according to the present invention.

With references to FIG. 1, there is depicted generally at 10 a portable electric string trimmer. The trimmer 10 shown generally comprises a housing element 12 having a motor housing portion 14 and a housing extension 16. The housing extension 16 is adapted to mount a wand 18 and handle 20 by which means the trimmer may be held during operation. The housing extension 16 and motor housing 14 are formed integrally and are generally hollow. The housing extension 16 further contains a hollow member or conduit for conducting a length of cutting filament 15 from a supply through the housing extension to the motor.

The motor housing 14 is an open bottomed structure and receives a conventional electric motor having a rotary power output shaft that is drivingly coupled to a slinger head (not shown) at the base of the motor housing 14. The slinger head is adapted to receive a length of filament for rotation therewith. A free end of the filament 15 extends out from the perimeter of the slinger head so that when the filament is rotated with the slinger head, the free end of the filament will be whipped around very rapidly and will define a cutting element for engaging and cutting through vegetation.

As shown in FIG. 1, a shield 17 is provided and supported below the motor housing 14. The shield serves to protect against stones or other debris being thrown back toward the operator.

The cutting filament 15 comprises a stationary supply of continuous filament line which is stored in a spool 21 which may be supported on the housing 12 or wand 18. In the preferred embodiment, an auxiliary handle 19 is mounted on the wand 18 to facilitate guidance of the trimmer during use. The spool 21 of cutting filament may be conveniently mounted on this auxiliary handle for convenient access thereto.

Further details of the construction and operation of the string trimmer 10 may be found in U.S. Pat. No. 4,338,719 to Burkholder, assigned to the assignee of the present invention.

Figure 2A:
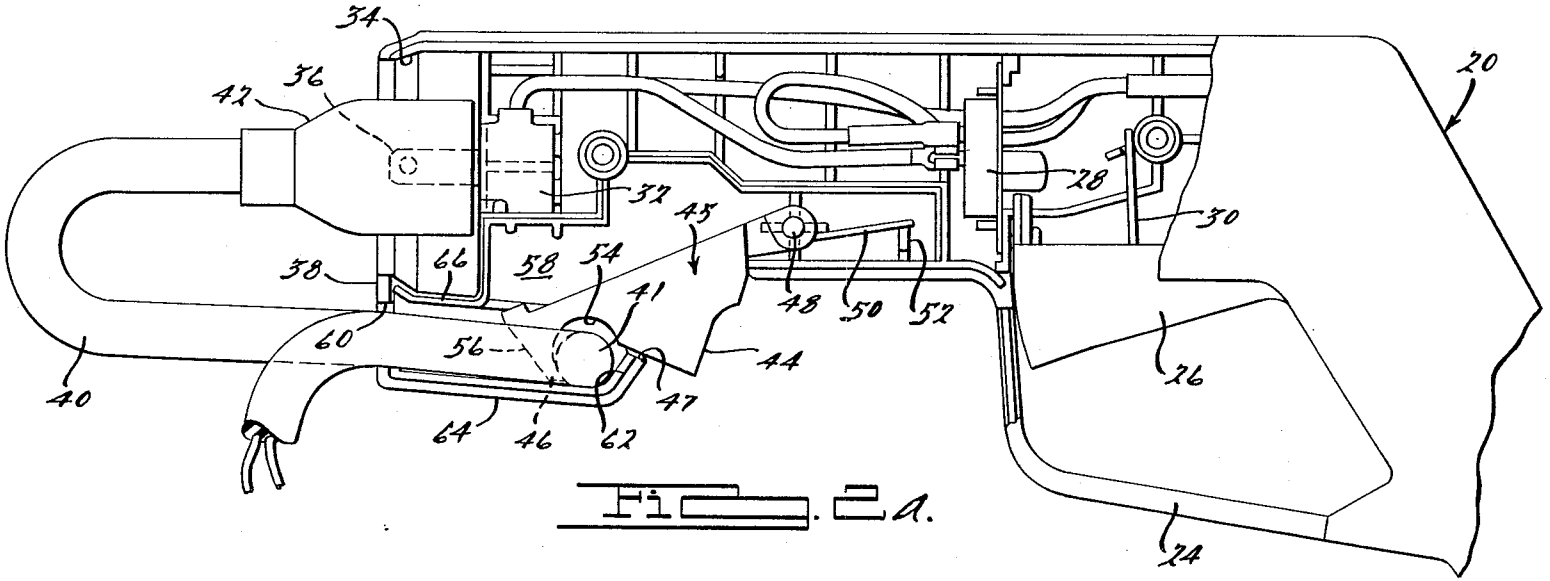
FIGS. 2*a*–2*c* are enlarged partial cutaway views of the handle portion of the tool shown in FIG. 1 illustrating the insertion and capture of the loop of extension cord by the cord retaining system.
Figure 2:
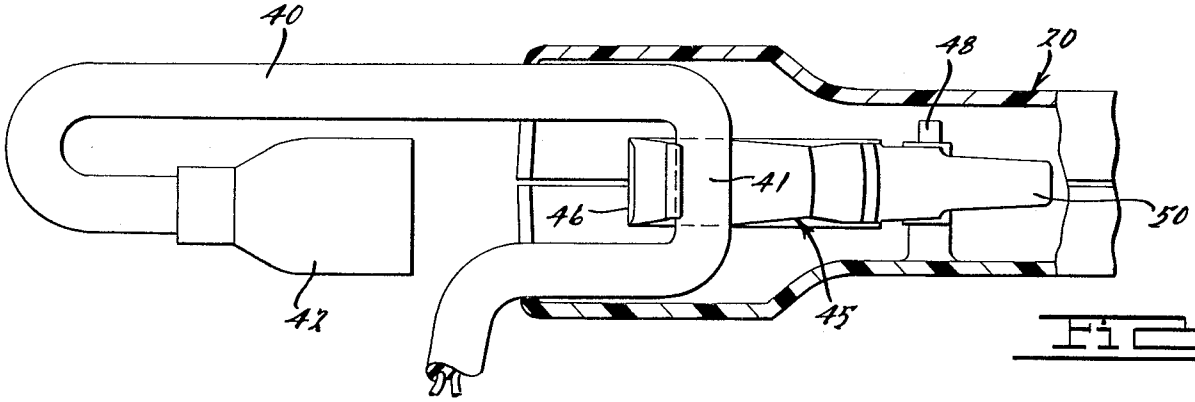

Referring to FIG. 2, an enlarged partial cutaway view of the upper handle portion of the string trimmer 10 incorporating the cord retaining system of the present invention is shown. The handle 20 is constructed of a molded plastic material and is formed from two complementary clamshell half sections that are joined together and secured by bolts to the upper end of metal wand 18. The handle 20 includes a trigger guard 24 and a trigger 26 that is pivotably mounted within the handle so that it projects from an opening in the underside of the handle 20. The trigger 26 is adapted to actuate an on/off switch 28 mounted within the handle when the trigger is pivoted upwardly in a clockwise direction against the bias of a trigger spring 30. The on/off switch 28 is also biased into the normally off position. The on/off switch 28 is electrically connected between the motor and a male receptacle 32 mounted at the rear of the handle 20 to control the application of electric power to the motor. The male receptacle 32 illustrated in the drawings is a conventional two-prong receptacle that is mounted within a recessed opening 34 formed in the rear of the handle 20. Preferably, the receptacle 32 is sufficiently recessed as shown so that the prongs 36 of the receptacle do not project beyond the end face 38 of the handle 20. The recessed opening 34 formed in the rear of the handle 20 is configured so as to easily accommodate the enlarged female connector end 42 of a conventional 12- or 14-gauge outdoor extension cord 40.

Once connected to the male receptacle 32, the present invention provides a unique means of securing the extension cord to the handle 20 of the string trimmer so as to prevent it from becoming accidentally disconnected from the tool. In particular, the cord retaining system according to the present invention is integrally designed with the handle 20 of the tool and includes a cord retention member 45 that is pivotably mounted at 48 within a cavity 58 formed in the handle 20. Retaining member 45 comprises a trigger portion 44 that projects from a second opening 47 in the underside of the handle, and a hook portion 46 that defines a semicircular recess 54 in the retaining member 45. As best illustrated in FIG. 2*a*, the diameter of the semicircular recess 54 in the retaining member 45 is greater than the diameter of a conventional 12-gauge outdoor extension cord--the largest sized extension cord that would typically be used with the product. The recess 54 in the retaining member 45, together with the bottom wall 64 of the handle 20, defines a capture zone or area into which a loop of the extension cord 40 is to be inserted. In addition, retaining member 45 has an integrally formed spring arm 50 extending forward of pivot 48 that acts upon a boss 52 formed in a wall of the handle 20 to bias the member 45 counterclockwise into its extended position.

Figures 2B, 2C:
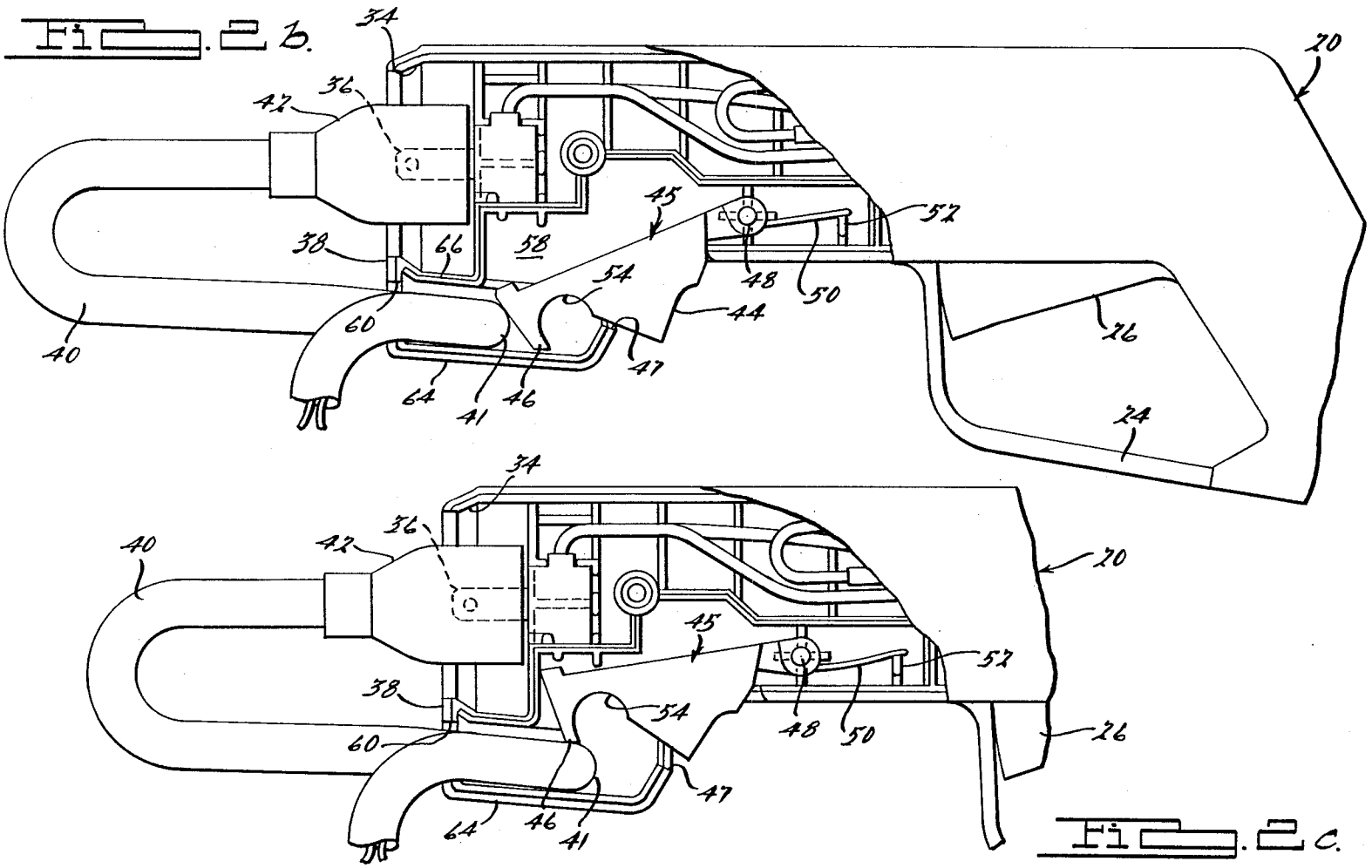

The present cord retaining system functions in the following manner. After the female end 42 of the extension cord 40 is plugged into the male receptacle 32, the user forms a loop in the extension cord. The loop of cord is then inserted into the opening 60 at the rear of the tool handle 20 below the male receptacle 32 along a pathway to a first position where it contacts a cam surface 56 formed on the rear face of the cord retaining member 45 (FIG. 2*b*). Further insertion of the loop of cord against the cam surface 56 causes the retaining member 45 to pivot upwardly in a clockwise direction against the bias of spring arm 50 (FIG. 2*c*) until the apex 41 of the loop of cord clears the hook portion 46 of the retaining member 45. A stop surface 62 defined by the upwardly projecting portion of the bottom wall 64 of the handle 20 immediately below the opening 47 establishes the base of the cavity 58 and is provided to prevent insertion of the cord 40 beyond the appropriate capture zone. Once the loop of cord is in this second position wherein the apex 41 of the loop has cleared the hook portion 46, the retaining member 45 snaps back downward to its original position under the force of spring arm 50, thereby capturing the loop of cord 40 within the recess 54 (FIG. 2*a*).

Figure 4:
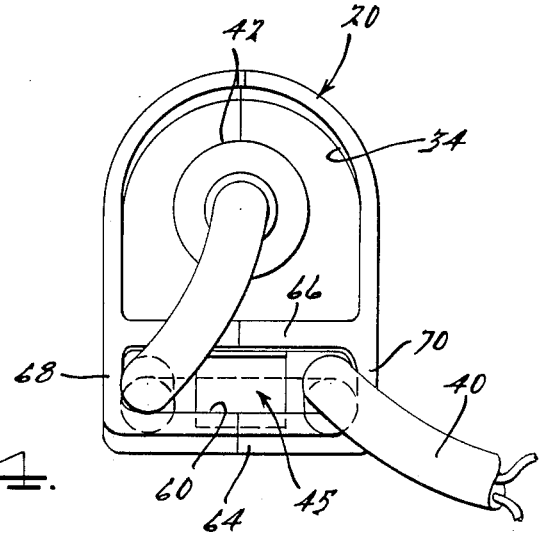
FIG. 4 is an end view of the handle portion shown in FIG. 2.

With particular reference to FIG. 4, it will be appreciated that when captured by the retaining member 45, the loop of cord is completely encircled on four sides by the walls of the handle 20, thereby insuring that the cord 40 is secured against accidental withdrawal. In particular, the opening 60 and accompanying pathway into which the cord 40 is inserted is defined by bottom wall 64, side walls 68 and 70, and upper wall 66, which also separates the cord opening 60 from the receptacle opening 34. The vertical spacing between the upper wall 66 and bottom wall 64 is such that the loop of cord is confined to a substantially horizontal plane when inserted into handle 20. By confining the loop of cord on all four sides as described, the cord 40 is prevented from twisting and pulling at odd angles during the use of the tool, which could result in the cord working itself free from the retaining member 45.

In addition, as best shown in FIG. 2, it will be noted that the pivot point 48 for the retaining member 45 is positioned as close as possible to the plane of the loop of cord. Thus, tension on the cord 40 will result in a pulling force that is directed along a line that defines a relatively shallow angle relative to the orientation of the retaining member 45. In this manner, tension on the cord 40 will only cause the cord loop to more tightly grip the hook portion 46 of the retaining member 45, rather than tending to pivot the retaining member upwardly out of engagement with the cord loop.

Figure 6:
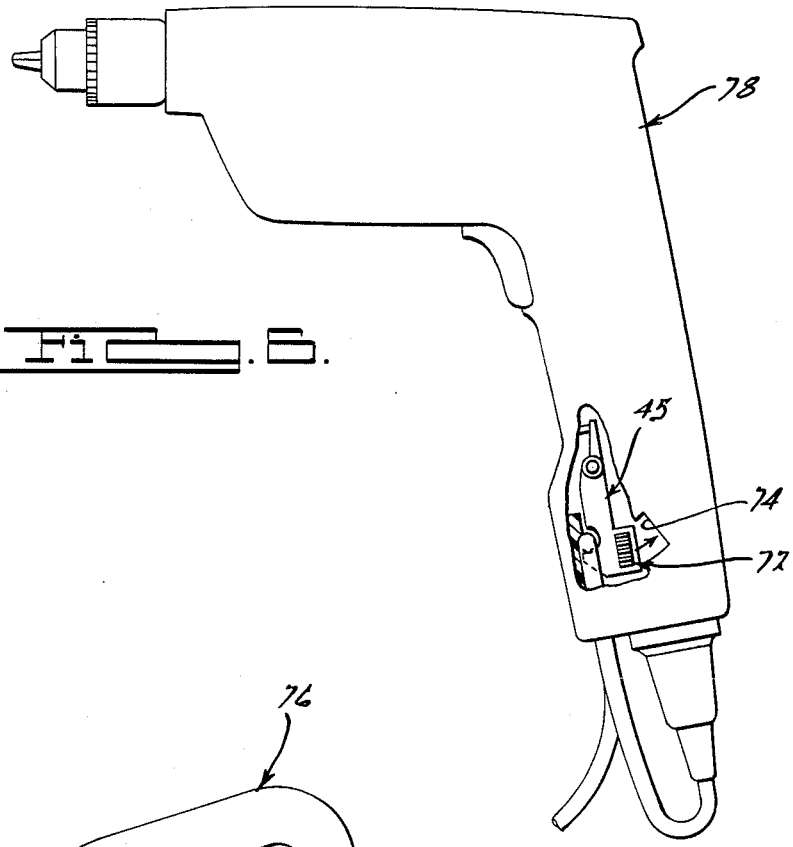
FIG. 6 is a perspective view of a portable electric drill incorporating an alternative embodiment of the cord retaining system according to the present invention.

To release the loop of cord 40, the trigger portion 44 is engaged by the user and retracted into the handle, causing the retaining member 45 to pivot upwardly freeing the loop of cord and thereby permitting the cord to be withdrawn from the handle 20. Optionally, as shown in FIG. 6, a release lever 72 may be provided which is integrally connected to the retaining member 45 and is accessible to the user through a slot 74 formed in the side of the handle 20. In this embodiment, the loop of cord is released by lifting the lever 72 to pivot the retaining member 45 upwardly out of engagement with the loop of cord 40.

As previously noted, the size of the semicircular recess 54 in the retaining member 45 is preferably larger than necessary to accommodate the diameter of the extension cord 40. The purpose of this oversized dimension is to provide a means of freeing the loop of cord 40 in the event it becomes stuck to the hook portion 46 of the retaining member 45. Specifically, under certain circumstances, particularly with a large extension cord that is relatively stiff, the loop of cord may become fairly tightly wrapped around the hook portion 46 of the retaining member 45. Under such circumstances, the loop of cord 40 may not freely drop out of the recess 54 when the retaining member 45 is raised. When this occurs, the oversized recess 54 allows the user of the tool to push the loop of cord 40 further into the handle a short distance and thereby free the loop of cord from the hook portion 46 of the retaining member 45.

Additionally, in applications where the use of relatively small-sized extension cords is contemplated, it may be found desirable to serrate of otherwise roughen the semicircular recessed surface 54 of the hook portion 46 of the retaining member 45 to improve the holding force of the retaining member 45.

Figure 5:
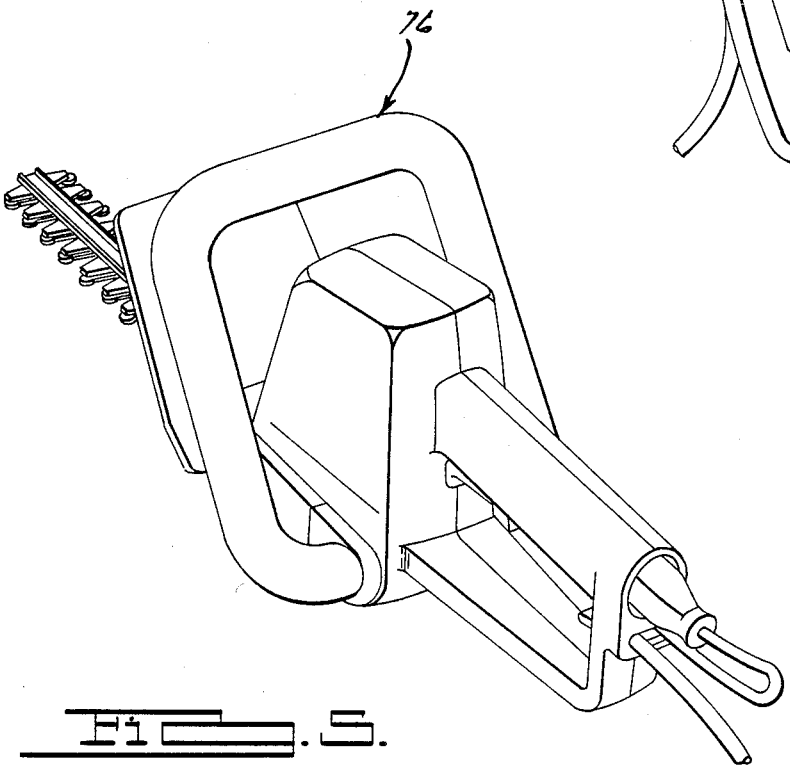
FIG. 5 is a perspective view of a portable electric hedge trimmer incorporating the cord retaining system of the present invention.

Referring to FIGS. 5 and 6, the application of the present invention to other types of portable electric power tools, including hedge trimmers 76 and drills 78, is also shown. These examples are intended to be illustrative of the adaptability of the present cord retaining system only and are not intended to suggest or imply that the present invention is not equally applicable to other types of portable electric power tools not specifically illustrated herein.

Thus, it will be appreciated that the present invention provides an improved cord retention system for releasably securing to a portable electric power tool the end of an extension cord that is electrically connected to the tool. In addition, the present cord retention system is integrally designed into the handle of the power tool and is therefore convenient and simple to operate. Moreover, the present invention is adapted to operate effectively with cords of various sizes and can be readily and inexpensively incorporated into a wide variety of existing power tool designs.

While the above description constitutes the preferred embodiments of the invention, it will be appreciated that the invention is susceptible to modification, variation, and change without departing from the proper scope or fair meaning of the accompanying claims.

What is claimed is:

1. A portable electric power tool comprising a motor, electrical connector means electrically connected to the motor and adapted for electrical connection to one end of a power cord, a housing having a first opening which communicates with a cavity formed in said housing that is adapted to receive a loop of said cord when inserted through said first opening, and a cord retaining member mounted within said cavity and movable between a first position wherein a portion of said retaining member is positioned between the apex of said loop of cord and said first opening whereby said cord is secured against withdrawal from said housing, and a second position wherein said portion of said cord retaining member is removed from between the apex of said loop of cord and said first opening thereby permitting said loop of cord to be withdrawn from said housing.

2. The portable electric power tool of claim 1 wherein said housing includes a handle for said tool and further wherein said first opening and said cavity are located in said handle.

3. The portable electric power tool of claim 2 further including bias means for biasing said cord retaining member into said first position.

4. The portable electric power tool of claim 1 further including a release member connected to said cord retaining member and accessible to a user of the tool through a second opening formed in said housing for permitting the user to move said cord retaining member from said first position to said second position.

5. The portable electric power tool of claim 3 wherein said cord retaining member includes camming means operatively associated with said loop for moving said cord retaining member against the bias of said bias means from said first position into said second position until the apex of said loop of cord is inserted beyond said portion of said cord retaining member.

6. The portable electric power tool of claim 5 wherein said camming means comprises a cam surface on said cord retaining member facing said first opening that is adapted to be contacted by said loop of cord as it is inserted into said cavity.

7. The portable electric power tool of claim 5 wherein said bias means is adapted to return said retaining member to said first position after said loop of cord is inserted beyond said portion of said retaining member.

8. The portable electric power tool of claim 1 wherein said first opening in said housing is defined by four walls of said housing which confine the loop of cord substantially to a single plane when inserted therein.

9. The portable electric power tool of claim 8 wherein said cord retaining member is adapted to move between said first and second positions along a path substantially perpendicular to said plane.

10. The portable electric power tool of claim 2 wherein said portion of said retaining member includes a hook and a recess in said retaining member which defines a capture zone for securing said loop of cord.

11. The portable electric power tool of claim 10 wherein the size of said recess is greater than the diameter of said cord.

12. A cord retaining system for securing a loop of cord in a housing of a portable electric power tool in which said housing of the tool includes a first opening which communicates with a cavity formed in said housing that is adapted to receive said loop of cord when inserted through said first opening;

said cord retaining system comprising a retaining member mounted within said cavity of said housing and movable between a first position wherein a portion of said retaining member is positioned between said loop of cord and said first opening whereby said cord is secured against withdrawal from said housing, and a second position wherein said portion of said retaining member is removed from between said loop of cord and said first opening thereby permitting said cord to be withdrawn from said housing.

13. The cord retaining system of claim 12 wherein said housing includes a handle for the tool and further wherein said first opening and cavity are located in said handle.

14. The cord retaining system of claim 13 further including bias means for biasing said retaining member into said first position.

15. The cord retaining system of claim 12 further including a release member connected to said retaining member and accessible to the user of a tool through a second opening formed in said housing for permitting the user to move said retaining member from said first position to said second position.

16. The cord retaining system of claim 14 wherein said retaining member includes camming means operatively associated with said loop for moving said retaining member against the bias of said bias means from said first position into said second position until the apex of said loop of cord is inserted beyond said portion of said retaining member.

17. The cord retaining system of claim 16 wherein said camming means comprises a cam surface on said retaining member facing said first opening that is adpated to be contacted by said loop of cord as it is inserted into said cavity.

18. The cord retaining system of claim 16 wherein said bias means is adapted to return said retaining member to said first position after said loop of cord is inserted beyond said portion of said retaining member.

19. The cord retaining system of claim 12 wherein said first opening in said housing is defined by four walls of said housing which confine the loop of cord substantially to a single plane when inserted therein.

20. The cord retaining system of claim 19 wherein said retaining member is adapted to move between said first and second positions along a path substantially perpendicular to said plane.

21. The cord retaining system of claim 13 wherein said portion of said retaining member includes a hook and a recess in said retaining member which defines a capture zone for securing said loop of cord.

22. The cord retaining system of claim 21 wherein the size of said recess is greater than the diameter of said cord.

23. A cord retaining system for securing a loop of extension cord in a handle of a portable electric power tool in which the handle of the tool includes a first opening which communicates with a cavity formed in said handle that is adapted to receive said loop of extension cord when inserted through said first opening; said cord retaining system comprising:

a retaining member pivotably mounted within said cavity of said handle, said retaining member having a hook portion and a recess formed therein adjacent said hook portion that defines a capture zone for said loop of extension cord; and spring means for biasing said retaining member into a first position wherein said hook portion obstructs the passage of said loop of extension cord between said first opening and said capture zone;

said retaining member further having a cam surface facing said first opening that is adapted to be contacted by the loop of extension cord as it is inserted through said first opening into said cavity for causing said retaining member to pivot against the bias of said spring means from said first position to a second position wherein said loop of cord is permitted to pass said hook portion into said capture zone whereby said spring means causes said retaining member to pivot back to said first position and capture said loop of extension cord in said recess;

said retaining member still further having manually actuable means accessible to a user of the tool through a second opening in said handle for pivoting said retaining member against the bias of said spring means from said first position to said second position to release said hook portion from said loop of extension cord and permit withdrawal of said loop of extention cord from said handle.

24. The cord retaining system of claim 23 wherein said first opening in said housing is defined by four walls of said housing which confine the loop of extension cord substantially to a single plane when inserted therein.

25. The cord retaining system of claim 24 wherein said retaining member is adapted to pivot between said first and second positions along a path substantially perpendicular to said plane.

26. The cord retaining system of claim 25 wherein the pivot point of said retaining member is located relatively close to said plane and the orientation of said retaining member in said first position relative to said plane defines a relatively small acute angle.

27. A portable electric power tool comprising a motor, electrical connector means electrically connected to the motor and adapted for electrical connection to one end of an extension cord, and a cord retaining system for securing a loop of the extension cord in a handle of the tool, said handle having a first opening which communicates with a cavity formed in said handle that is adapted to receive said loop of extension cord when inserted through said first opening; said cord retaining system including:

a retaining member pivotably mounted within said cavity of said handle, said retaining member having a hook portion and a recess formed therein adjacent said hook portion that defines a capture zone for said loop of extension cord; and spring means for biasing said retaining member into a first position wherein said hook portion obstructs the passage of said loop of extension cord between said first opening and said capture zone;

said retaining member further having a cam surface facing said first opening that is adapted to be contacted by the loop of extension cord as it is inserted through said first opening into said cavity for causing said retaining member to pivot against the bias of said spring means from said first position to a second position wherein said loop of cord is permitted to pass said hook portion into said capture zone whereby said spring means causes said retaining member to pivot back to said first position and capture said loop of extension cord in said recess;

said retaining member still further having manually actuable means accessible to a user of the tool through a second opening in said handle for pivoting said retaining member against the bias of said spring means from said first position to said second position to release said hook portion from said loop of extension cord and permit withdrawal of said loop of extension cord from said handle.

28. The portable electric power tool of claim 27 wherein said first opening in said housing is defined by four walls of said housing which confine the loop of extension cord substantially to a single plane when inserted therein.

29. The portable electric power tool of claim 28 wherein said retaining member is adapted to pivot between said first and second positions along a path substantially perpendicular to said plane.

30. The portable electric power tool of claim 29 wherein the pivot point of said retaining member is located relatively close to said place and the orientation of said retaining member in said first position relative to said plane defines a relatively small acute angle.

31. A portable electric power tool comprising a motor, electrical connector means electrically connected to the motor and adapted for electrical connection to one end of an extension cord, a handle, and a cord retaining system for securing a loop of the extension cord in a capture area within said handle, including a first opening in said handle communicates via a pathway to said capture area for permitting said loop of extension cord to be inserted thereinto, a retaining member mounted within said handle adjacent said capture area and movable between a first position wherein said retaining member obstructs said pathway and thereby prevents the withdrawal of said loop of extension cord from said capture area and a second position wherein said retaining member does not obstruct said pathway and thereby permits said loop of extension cord to be inserted into or withdrawn from said capture area, and actuator means connected to said retaining member and accessible to a user of the tool through a second opening in said handle for moving said retaining member from said first to said second positions.

32. The portable electric power tool of claim 31 further including spring means for biasing said retaining member into said first position.

33. The portable electric power tool of claim 32 further including means for automatically moving said retaining member from said first position to said second position as said loop of extension cord is inserted into said first opening along said pathway to said capture area.

34. The portable electric power tool of claim 33 wherein said retaining member includes a cam surface facing said first opening and adapted to engage said loop of extension cord as it is inserted into said first opening toward said capture area to cam said retaining member from said first position to said second position.

35. The portable electric power tool of claim 31 wherein said first opening in said handle is defined by four walls of said handle which form said pathway and confine the loop of extension cord substantially to a single plane when inserted therein.

36. The portable electric power tool of claim 35 wherein said retaining member is adapted to move between said first and second positions along a path substantially perpendicular to said plane.

37. A cord retaining system for securing a loop of extension cord in a capture area within a handle of a portable electric power tool, including a first opening in said handle that communicates via a pathway to said capture area for permitting said loop of extension cord to be inserted thereinto, a retaining member mounted within said handle adjacent said capture area and movable between a first position wherein said retaining member obstructs said pathway and thereby prevents the withdrawal of said loop of extension cord from said capture area and a second position wherein said retaining member does not obstruct said pathway and thereby permits said loop of extension cord to be inserted into or withdrawn from said capture area, and actuator means connected to said retaining member and accessible to the user of the tool through a second opening in said handle for moving said retaining member from said first to said second positions.

38. The cord retaining system of claim 37 further including spring means for biasing said retaining member into said first position.

39. The cord retaining system of claim 38 further including means for automatically moving said retaining member from said first position to said second position as said loop of extension cord is inserted into said first opening along said pathway to said capture area.

40. The cord retaining system of claim 39 wherein said retaining member includes a cam surface facing said first opening and adapted to engage said loop of extension cord as it is inserted into said first opening toward said capture area to cam said retaining member from said first position to said second position.

41. The cord retaining system of claim 40 wherein said first opening in said handle is defined by four walls of said handle which form said pathway and confine the loop of extension cord substantially to a single plane when inserted therein.

42. The cord retaining system of claim 41 wherein said retaining member is adapted to move between said first and second positions along a path substantially perpendicular to said plane.

43. A portable electric power tool comprising a motor, electrical connector means electrically connected to the motor and adapted for electrical connection to one end of an extension cord, a housing having a first opening which communicates with a cavity formed in said housing that is adapted to receive a loop of said extension cord when inserted through said first opening, and cord retaining means responsive to the insertion of said loop of extension cord into said cavity for causing said cord retaining means to move and capture said loop of extension cord to thereby automatically retain said loop of extension cord in said cavity.

44. The portable electric power tool of claim 43 wherein said cord retaining means captures said loop when said loop is moved from a first position to a second position.

45. The portable electric power tool of claim 43 wherein said tool includes a handle and said cavity is located within said handle.

46. The portable electric power tool of claim 43 wherein said cord retaining means includes camming means operatively associated with said loop of extension cord for causing said cord retaining means to move from a retaining position to a release position upon insertion of said loop of extension cord into said cavity.

47. The portable electric power tool of claim 46 further including bias means for normally biasing said cord retaining means into said retaining position.

48. The portable electric power tool of claim 47 wherein said bias is adapted to return said cord retaining means to said retaining position after said loop of extension cord has been completely inserted into said cavity.

49. The portable electric power tool of claim 43 further including release means connected to said cord retaining means and accessible to a user of the tool through a second opening in said housing for causing said cord retaining means to release said loop of extension cord and permit withdrawal thereof from said cavity.

50. A cord retaining system for securing a loop of an extension cord within a cavity formed in the housing of a portable electric power tool including retaining means located within said cavity and responsive to the insertion of said loop of extension cord into said cavity for causing said retaining means to move from a release position to a capture position to thereby automatically retain said loop of extension cord in said cavity.

51. The cord retaining system of claim 50 wherein said retaining means captures said loop when said loop is moved from a first position to a second position.

52. The cord retaining system of claim 50 wherein said tool includes a handle and said cavity is located within said handle.

53. The cord retaining system of claim 50 wherein said first means includes a cord retaining member and camming means operatively associated with said loop of extension cord for causing said cord retaining member to move from a retaining position to a release position upon insertion of said loop of extension cord into said cavity.

54. The cord retaining system of claim 53 wherein said first means further includes bias means for normally biasing said cord retaining member into said retaining position.

55. The cord retaining system of claim 54 wherein said bias means is adapted to return said cord retaining member to said retaining position after said loop of extension cord has been completely inserted into said cavity.

56. The cord retaining system of claim 50 further including second means connected to said first means and accessible to a user of the tool through an opening in said housing for causing said first means to release said loop of extension cord and permit withdrawal thereof from said cavity.

57. A portable electric power tool comprising a motor, electrical connector means electrically connected to the motor and adapted for electrical connection to one end of an extension cord, a housing having a first opening which communicates with a cavity formed in said housing that is adapted to receive a loop of said extension cord when inserted through said first opening, retaining means for releasably securing said loop of extension cord in said cavity, and means for maintaining said loop of extension cord substantially in a single plane within said cavity.

58. The portable electric power tool of claim 57 wherein said last-mentioned means is operatively associated with said retaining means.

59. The portable electric power tool of claim 57 wherein said tool includes a handle and said cavity is located within said handle.

60. A cord retention system for securing a loop of an extension cord within a cavity formed in a housing of a portable electric power tool including first means for releasably securing said loop of extension cord in said cavity, and second means for maintaining said loop of extension cord substantially in a single plane within said cavity.

61. The cord retaining system of claim 60 wherein said second means is operatively associated with said first means.

62. The cord retaining system of claim 60 wherein said tool includes a handle and said cavity is located within said handle.

63. A method of releasably securing a loop of extension cord having male and female connector ends within a cavity formed in a housing of a portable electric power tool having a motor and male connector means electrically connected to the motor, wherein the cavity within the housing has a capture area at the base thereof, and further wherein there is movably mounted in said cavity adjacent said capture area a retaining member; including the steps of:

connecting the female connector end of the extension cord to said male connector means;

forming a loop in the extension cord adjacent said female connector end;

inserting said loop of extension cord into said cavity in said housing;

moving said retaining member to a first position providing unobstructed access to said capture area;

inserting said loop of extension cord into said capture area at the base of said cavity; and moving said retaining member from said first position to a second position obstructing access to said capture area to confine said loop of extension cord to said capture area and thereby secure said loop of extension cord against withdrawal from said cavity.

64. The method of claim 63 wherein the steps of inserting said loop of extension cord into said cavity to said capture area is effective to automatically move said retaining member from said second position to said first position.

65. The method of claim 63 further including the steps of moving said retaining member from said second position to said first position to release said loop of extension cord from said capture area, and withdrawing said loop of extension cord from said cavity.

66. The method of claim 65 wherein said retaining member is normally biased into said second position and said retaining member must be held in said first position to release said loop of extension cord.

67. A method of releasably securing a loop of extension cord having male and female connector ends within a cavity formed in a housing of a portable electric power tool having a motor, male connector means electrically connected to the motor, and moveable cord retaining means for automatically securing a loop of extension cord within said cavity upon insertion of said loop of extension cord into said cavity; including the steps of:

connecting the female connector end of the extension cord to said male connector means;

forming a loop in the extension cord adjacent said female connector end; and inserting said loop extension cord into said cavity and thereby causing said cord retaining means to move from release position to a capture position to that said loop is secured by said retaining means.

68. The method of claim 67 further including the steps of actuating said cord retaining means into said release position and withdrawing said loop of extension cord from said cavity.

* * * * *

UNITED STATES PATENT AND TRADEMARK OFFICE

CERTIFICATE OF CORRECTION

PATENT NO. : 4,875,879

DATED : October 24, 1989

INVENTOR(S) : Roderick F. Bunyea et al.

It is certified that error appears in the above-identified patent and that said Letters Patent is hereby corrected as shown below:

Column 2, line 4, "references" should be --reference--.

Column 4, line 45, "of" should be --or--.

Column 8, line 24, claim 30, "place" should be --plane--.

Column 8, line 33, claim 31, after "handle", insert --that--.

Column 10, line 7, claim 48, after "bias", insert --means--.

Column 12, line 33, claim 67, "to" (second occurrence) should be --so--.

Column 12, line 31, claim 67, after "loop", insert --of--.

Signed and Sealed this

Ninth Day of October, 1990

*Attest:*

*Attesting Officer*

HARRY F. MANBECK, JR.

*Commissioner of Patents and Trademarks*